United States Patent [19]

Aiello, Jr.

[11] 4,317,161

[45] Feb. 23, 1982

[54] COMBINED BATTERY HOLDER AND SWITCH

[75] Inventor: Samuel Aiello, Jr., Royal Oak, Mich.

[73] Assignee: Ilo Engineering, Inc., Troy, Mich.

[21] Appl. No.: 98,937

[22] Filed: Nov. 30, 1979

[51] Int. Cl.[3] ..... F21L 15/08

[52] U.S. Cl. ..... 362/103; 362/190

[58] Field of Search ..... 362/103, 190, 191

[56] References Cited

U.S. PATENT DOCUMENTS

| | | | |
|---|---|---|---|
| 2,520,503 | 8/1950 | Henning | 362/191 |
| 3,675,005 | 7/1972 | Curiel | 362/103 |
| 3,720,918 | 3/1973 | Perl | 362/103 |

*Primary Examiner*—Donald P. Walsh

*Attorney, Agent, or Firm*—Barnes, Kisselle, Raisch & Choate

[57] ABSTRACT

A combined battery holder and switch which comprises a strip of elastic fabric having its opposite ends connected to form an annular member adapted to be stretched lengthwise around a dry cell battery of the type having a terminal at each of its opposite ends. A pair of diametrically opposed metal grommets are secured to the annular elastic member so that each overlies one of the battery terminals. One of the grommets comprises an electrical contact to which a conductor is attached. The other grommet is insulated from the other terminal of the battery and supports a metal sleeve into which a stud is threaded. The stud is electrically connected to another conductor and is adapted to be threaded into and out of contact with the adjacent terminal to open and close the circuit between the battery and the electrical device to which the conductors are connected. A cover having a "Velcro" surface is wrapped around the assembly of the elastic member and the battery.

14 Claims, 3 Drawing Figures

COMBINED BATTERY HOLDER AND SWITCH

This invention relates to a combined battery holder and switch.

In my prior U.S. Pat. No. 3,450,872, dated June 17, 1969, there is disclosed an illuminated hairpiece which includes a molded plastic holder for a small dry cell battery, the holder having contacts inserted in its opposite ends and connected with the ends of electrical conductors. One of the contacts directly engages the terminal at one end of the battery and the other contact receives a threaded switch member adapted to be advanced into contact with the terminal at the opposite ends of the battery to close the circuit through a series of small light bulbs in the circuit of the electrical conductors.

The object of the present invention resides in the provision of an improved combined battery holder and switch arrangement which is more economical to manufacture, easier to use, and which has wide application in conjunction with many types of electrical devices in which the power source is a small dry cell battery having terminals at its opposite ends.

Other objects, features and advantages of the present invention will become apparent from the following description and accompanying drawing, in which.

Figures 1, 2, 3:
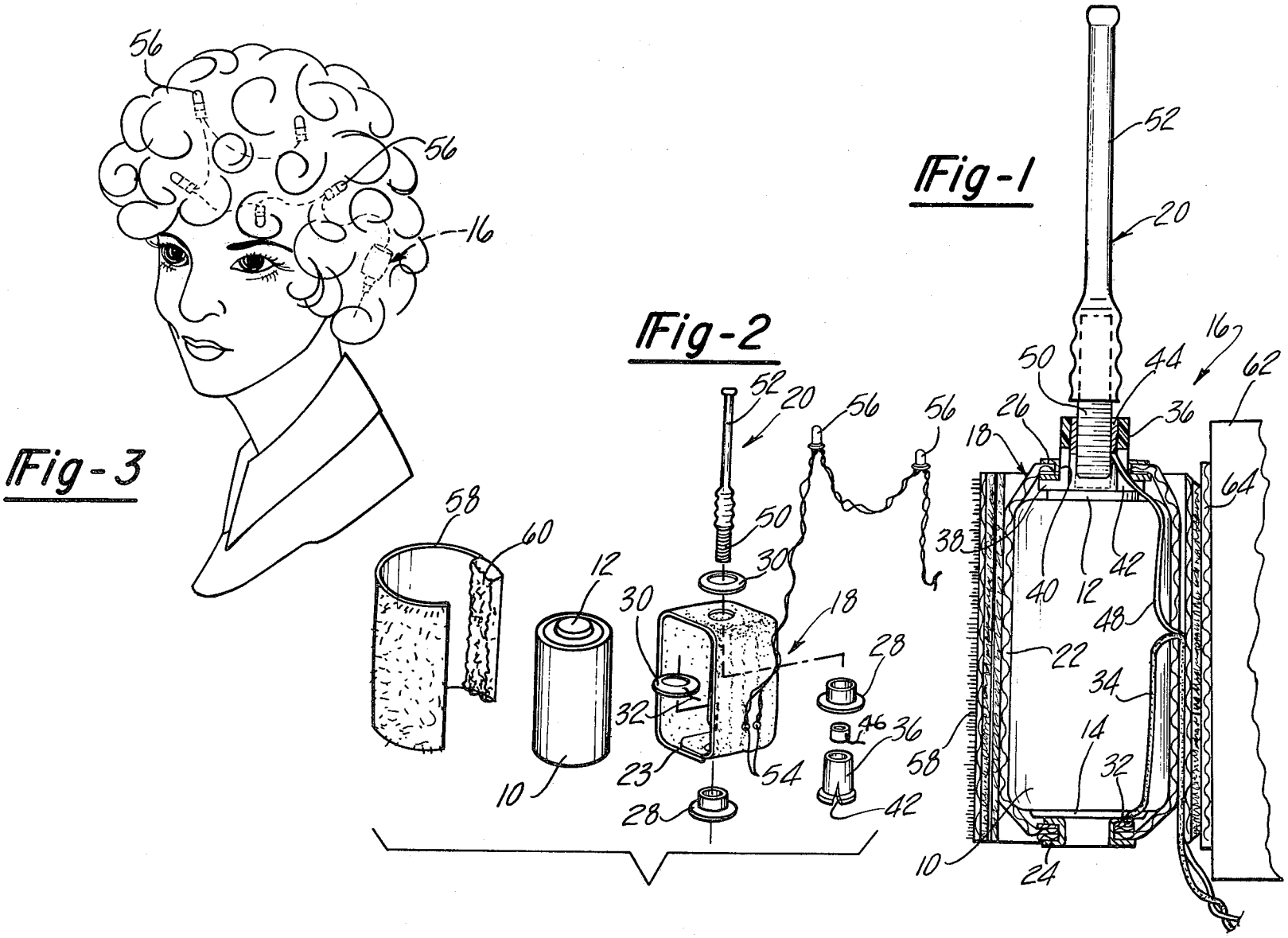
FIG. 1 is a sectional view of the combined battery holder and switch of the present invention illustrating its assembly with a battery.
FIG. 2 is an exploded view of the various components shown in FIG. 1.
FIG. 3 is a view showing the device employed in conjunction with an illuminated hairpiece.

Referring to the drawing, the numeral 10 designates a conventional dry cell battery of the mercury type having terminals 12 and 14 at the axially opposite ends thereof. The combined battery holder and switch of this invention is generally designated 16 and generally comprises a holder 18 and a switch 20. Holder 18 consists of a strip of elastic fabric 22, the opposite ends of which overlap as at 23 (FIG. 2) and are connected together by a grommet 24. Diametrically opposite the grommet 24 a similar grommet 26 is secured to elastic strip 22. Each of the metal grommets 24,26 are of the conventional type consisting of a tubular flanged ferrule 28 which extends through an aperture in elastic strip 22 and is crimped over a disc 30 to firmly retain the ferrule on the strip. When the ends of elastic strip 22 are connected together as described, it forms an annular member which is adapted to be stretched around battery 10 so that grommet 24 overlies terminal 14 and grommet 26 overlies terminal 12.

When grommet 24 is crimped over the overlapping ends of strip 22 the bared end 32 of a conductor 34 is crimped between ferrule 28 and disc 30 so as to establish electrical contact between grommet 24 and conductor 34. A plastic tubular member 36 extends outwardly through the other grommet 26. Tubular member 36 has an annular flange 38 at its inner end which limits the extent to which member 36 projects outwardly through grommet 26 and also insulates grommet 26 from the adjacent terminal 12 of the battery. The portion of tubular member 36 adjacent flange 38 preferably has a diameter at least slightly larger than the diameter of the opening 40 in grommet 26. On diametrically opposite sides thereof the inner end portion of tubular member 36, inlcuding flange 38, is axially slotted as at 42 so that member 36 can be press fitted into grommet 26 with a relatively tight fit. Within the outer end of tubular member 36 there is press fitted an internally threaded steel sleeve 44. The bared end 46 of a second conductor 48 is arranged between sleeve 44 and the inner periphery of tubular member 36 so that conductor 48 is in good electrical contact with sleeve 44.

The switch 20 comprises a stud 50 in threaded engagement with sleeve 44. An elongated flexible arm 52 is fixedly secured to the outer end of stud 50. It will be appreciated that by rotating switch 20 in opposite directions stud 50 can be displaced axially into and out of engagement with terminal 12 so as to close and open the electrical circuit through conductors 34,48.

As shown in FIG. 1, the end portions of conductors 34,48 which are connected to grommet 24 and to threaded sleeve 44 extend interiorly of the annular elastic strip 22. At a portion intermediate the two grommets, strip 22 is formed with one or more apertures 54 through which the conductors 34,48 extend to the exterior of elastic strip 22.

In the embodiment illustrated the combined battery holder and switch of this invention is designed for use in an illuminated hairpiece and the conductors 34,48 are connected with a series of small light emitting diodes 56. The diodes 56 are arranged in a desired pattern throughout a woman's coiffure to provide a very attractive appearance. In a hairpiece of this type it is, of course, desirable that the battery, the battery holder and the switch all be concealed within the woman's coiffure. To facilitate the retention of the assembly within a woman's coiffure there is provided a wrap-around cover 58 for the assembly of the battery 10 and the elastic annular member 22. Cover 58 is preferably a fabric material of the type adapted to adhere to another similar material in a releasable fashion when the two materials are pressed together. The most common of these materials is illustrated in U.S. Pat. No. 2,717,437 and is sold commercially as "Velcro". Materials of this type usually include one surface provided with a plurality of hook-shaped synthetic filaments adapted to be pressed into engagement with a short pile fabric surface in order to secure the two surfaces together. A material of this type is admirably suited as a cover for the assembly since its outer surface will readily adhere to the hair strands of a woman's coiffure. The strip 58 has a length preferably greater than the circumference of the assembly of elastic strip 22 and battery 10 so that the ends of the strip are adapted to overlap. One end of the strip is hemmed as at 60 so that at one end the strip has the desired surface characteristics on both the inner and outer faces thereof. Thus, the strip 58 can be wound around the assembly and hemmed end 60 can be pressed against the underlying end of the strip so as to firmly retain the cover around the assembly of the battery and elastic strip 22.

Cover 58 also encloses portions of the conductors 34,48 which extend outwardly through the opening 54. Thus, the inner end portions of these conductors are frictionally retained between the outer surface of the battery and the inner surface of elastic strip 22 sand outer portions of these conductors are frictionally retained between the outer surface of strip 22 and the inner surface of cover 58. This arrangement is desirable because it tends to eliminate a direct pull on the portions of the conductors connected to the two contacts when the portions of the conductors remote therefrom are tensioned in any manner.

Although the arrangement illustrated is ideally suited for use in an illuminated hairpiece, it will be appreciated that the assembly is adapted to be used in connection with any electrical deivce that is operated by a conventional dry cell battery. The provision of the type of cover 58 disclosed is especially desirable since the battery assembly can be supported in many different ways. For example, if the battery circuit is used for illuminating a safety light on a pedestrian, the pedestrian can simply wear an arm or leg band 62 to which a strip of material similar to that from which cover 58 is made is attached. In FIG. 1 this strip of additional material is designated 64. It will be appreciated, however, that the arm band itself could be formed of the same material as cover 58.

I claim:

1. A combined battery holder and switch for use with an electrically energized device comprising a circumferentially continuous, annular, resiliently elastic member adapted and dimensioned to be stretched around an elongate cylindrical battery having a terminal at each of the axially opposite ends thereof so that the elastic member encircles the battery lengthwise in tight fitting relation, said elastic member having a pair of diametrically opposed fittings thereon, each adapted to overlie a terminal at the opposite ends of the battery when stretched lengthwise thereover, one of said fittings comprising an electrical contact member to which a conductor for the electrically energized device is fixedly connected, said contact being adapted to be biased into contacting engagement with one of said terminals by the resiliency of said elastic member when so stretched over the battery, the other fitting being adapted to be biased into contact with the other terminal at the opposite end of the battery by the elastic member and including a sleeve formed of an electrically conductive material and to which a second conductor for the electrically energized device is fixedly connected, said sleeve being axially aligned with said other terminal of the battery, said fitting also including an electrically insulating member arranged to lie between said sleeve and said other terminal of the battery when the sleeve is stretched over the battery such as to insulate the sleeve from the battery terminal and a stud formed of electrically conductive material within said sleeve and in electrical contact therewith, said stud being axially displaceable in said sleeve while in electrical contact therewith into and out of contacting engagement with said other terminal to open and close the circuit through said electrical device.

2. The combined battery holder and switch called for in claim 1 wherein said conductors extend from said fittings interiorly of said elastic member so that, when the elastic member is stretched around the battery, the end portions of the two conductors adjacent the terminals are frictionally retained against the outer surface of the battery by the resiliently elastic member.

3. The combined battery holder and switch called for in claim 2 wherein said sleeve is press fitted into the tubular element.

4. The combined battery holder and switch called for in claim 3 wherein the second conductor has a bared end firmly engaged between the inner periphery of the tubular element and the outer periphery of the sleeve.

5. The combined battery holder and switch called for in claim 1 wherein said other fitting comprises an apertured grommet fixed to said elastic member and said insulating member comprises a tubular element extending through said grommet.

6. The combined battery holder and switch called for in claim 5 wherein said tubular element is provided with a radially outwardly extending flange at its inner end which limits the extent to which the tubular element extends outwardly through the grommet and provides an annular insulating disc disposed to lie between the grommet and the adjacent terminal of the battery.

7. The combined battery holder and switch called for in claim 6 wherein the sleeve is press fitted into the outer end of the tubular element.

8. The combined battery holder and switch called for in claim 7 wherein the inner end portion of the tubular element adjacent the flange thereon has an outer diameter at least slightly larger than the aperture in the grommet, said end portion of the tubular elememt being axially slotted so that the tubular element may be pressed into the grommet into tight fitting engagement therewith.

9. The combined battery holder and switch called for in claim 8 wherein said sleeve is located adjacent the outer end of the tubular element and its inner end is spaced axially outwardly from said flange, said other conductor extending from interiorly of the elastic member axially through said axially slotted portion of the tubular element into contacting engagement with said sleeve.

10. The combined battery holder and switch called for in claim 5 wherein the first fitting comprises a second apertured grommet substantially identical to the first-mentioned grommet.

11. The combined battery holder and switch called for in claim 1 wherein said sleeve is internally threaded and said stud is threaded for axial displacement in said sleeve.

12. The combined battery holder and switch called for in claim 1 including a tubular cover adapted to circumferentially encircle and firmly embrace the assembly of the elastic member and the battery retained therein, substantially the outer surface of the cover being formed of a material adapted to releasably adhere to another surface comprising essentially a multitude of pile filaments.

13. The combined battery holder and switch called for in claim 12 wherein the outer surface of said cover has a multitude of short hook-shaped filaments thereon.

14. The combined battery holder and switch called for in claim 13 wherein said cover comprises a fabric sheet adapted to be wrapped circumferentially around the assembly of the elastic member and the battery retained therein, said sheet having a length greater than the circumference of the assembly of the elastic member and battery so that the ends of the sheet overlap one another, the inner surface of said sheet at one end thereof being adapted to releasably adhere to the outer surface of the other end of the sheet to maintain the cover in wrapped condition around said assembly.

* * * * *